US006789395B2

(12) United States Patent
Molino et al.

(10) Patent No.: US 6,789,395 B2
(45) Date of Patent: Sep. 14, 2004

(54) CONVERTIBLE PENDANT JEWELRY

(75) Inventors: William Molino, Valley Cottage, NY (US); Igor Dranovsky, New City, NY (US); Mikhail Buryakov, New City, NY (US)

(73) Assignee: Molino Jewellers, Pomona, NY (US)

( * ) Notice: Subject to any disclaimer, the term of this patent is extended or adjusted under 35 U.S.C. 154(b) by 0 days.

(21) Appl. No.: 10/456,188

(22) Filed: Jun. 6, 2003

(65) Prior Publication Data

US 2004/0020243 A1 Feb. 5, 2004

Related U.S. Application Data

(60) Provisional application No. 60/399,281, filed on Jul. 30, 2002.

(51) Int. Cl.[7] ..... A44C 13/00

(52) U.S. Cl. ..... 63/1.16; 63/29.1; 63/31; 63/40

(58) Field of Search ..... 63/29.1, 31, 40, 63/23, 1.16, 1.17

(56) References Cited

U.S. PATENT DOCUMENTS

| | | | | | |
|---|---|---|---|---|---|
| 770,573 | A | * | 9/1904 | Hacherelle | 63/23 |
| 1,032,257 | A | * | 7/1912 | Walrow | 63/23 |
| D59,529 | S | * | 10/1921 | Weed | D11/79 |
| 1,797,703 | A | * | 3/1931 | Sulger et al. | 63/20 |
| 3,381,495 | A | * | 5/1968 | Emerson | 63/33 |
| 4,034,573 | A | * | 7/1977 | Elkaim | 63/31 |
| D247,881 | S | * | 5/1978 | Hitchens | D11/41 |
| 4,245,486 | A | * | 1/1981 | Matsumoto et al. | 63/23 |
| 4,381,653 | A | * | 5/1983 | Diehl | 63/33 |
| 4,461,158 | A | * | 7/1984 | Diehl | 63/33 |
| 4,512,748 | A | * | 4/1985 | Matsumoto et al. | 446/354 |
| 4,542,631 | A | * | 9/1985 | Esser, III | 63/31 |
| 4,967,574 | A | * | 11/1990 | Bielka | 63/23 |
| 4,970,878 | A | * | 11/1990 | Lee | 63/23 |
| 6,070,435 | A | * | 6/2000 | Davidziak | 63/23 |
| 6,082,139 | A | * | 7/2000 | Davidziak | 63/23 |

FOREIGN PATENT DOCUMENTS

| | | | | |
|---|---|---|---|---|
| JP | 2000106924 | * | 4/2000 | |
| JP | 2000106924 A | * | 4/2000 | A44C/25/00 |

* cited by examiner

*Primary Examiner*—Robert J. Sandy
*Assistant Examiner*—Katherine Mitchell
(74) *Attorney, Agent, or Firm*—I. Zborovsky

(57) ABSTRACT

A pendant necklace having a chain and a pendant. The pendant can convert from a first closed configuration, such as a Star of David, heart, or cross, to at least one open configuration such that multiple decorative looks are available. The pendant comprises at least three elements which are pivotably connected, and the pendant elements are prevented from pivoting about each other to a predetermined angle by pivot stops so that the open configuration does not inadvertently go to the closed configuration when in the open configuration.

9 Claims, 16 Drawing Sheets

FIG. 5a
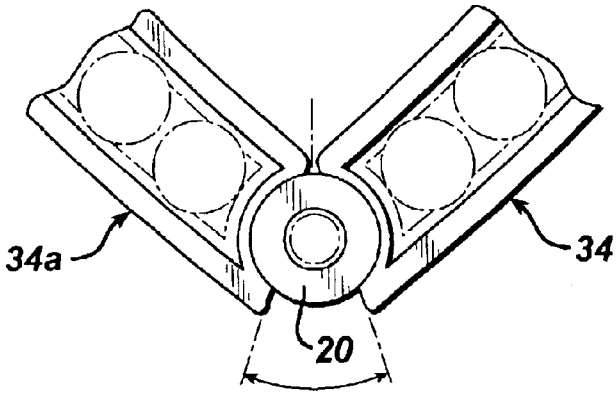
FIG. 5b
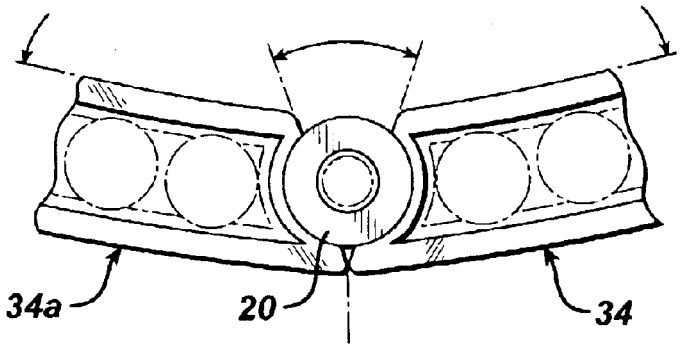
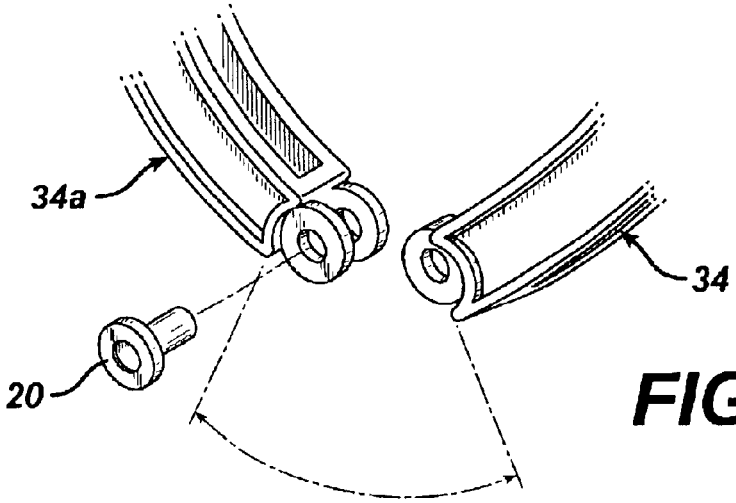
FIG. 5c

CONVERTIBLE PENDANT JEWELRY

RELATED APPLICATIONS

This application is related to Provisional Application Ser. No. 60/399,281 filed on Jul. 30, 2002 entitled Convertible Pendant Jewelry. The entire disclosure of this provisional application is incorporated herein by reference.

FIELD OF THE INVENTION

This invention relates to a novel pendant jewelry, e.g., a necklace, that can be converted from pendant jewelry of a first configuration to pendant jewelry of a second configuration or even third configuration.

PRIOR ART

Prior art relevant references are:

U.S. Pat. No. 3,381,495 to Emerson describes a convertible emblem that has a plurality of plates pivotally attached at one of the corners and superposed one upon the other. When the plates are closed, they form a framed symbol and when they are spread apart, they form a series of letters associated in meaning with the symbol.

U.S. Pat. No. 1,032,257 to Walrow describes a pendant article of jewelry, in particular a cross made up of two members in pivotal relation with each other at points intermediate of the ends of each, one of the members being provided with a slot through which the other member extends, which can be converted to an elongated article of jewelry. The jewelry hangs from a single eye at the top of the cross.

U.S. Pat. No. 4,718,252 to Fossas describes a balancing means provided as part of an ornament worn around the neck for maintaining an inertial balance and predetermined degree of symmetry about the neck while alleviating or eliminating pressure directly exerted on the neck.

U.S. Pat. No. 4,461,158 to Diehl describes an article of jewelry in the shape of a butterfly or insect that has two attachments, one for each end of a chain or a string. The attachments are fixed to the free ends of rigid wires, the other ends of the wires being fastened to a body of the article of jewelry so they articulate freely with the body.

U.S. Pat. No. 4,334,413 to Gaston et al describes an adjustable necklace that may be assembled rapidly without soldering.

U.S. Pat. No. 4,265,098 to Wayne describes a device for carrying a removable pendant from a chain or necklace which has an aperture into which is inserted the top bar of a T-shaped member which carries the pendant. Means are provided for locking the pendant within the device.

U.S. Pat. No. 4,034,573 to Elkaim describes an ornament which consists of at least two members suspended from a necklace, wristlet or similar retaining member. Each of the two members is movable relative to the retaining member because of a loop or ring affixed to each of the various members and through which the retaining member passes.

Japanese P2000-106924A describes a necklace that is changeable from a large four-sided pendant to a smaller four-sided pendant. The large pendant configuration consists of a central four-sided member surrounded by four adjacent stems meeting the top of the small four-sided pendant to form the large pendant that hangs from a chain member. When the four stems are parted the smaller four-sided pendant drops down and the four stems become part of the chain to form a second smaller pendant configuration.

Other references of interest are U.S. Pat. No. Des. 292,180 to Seraile, U.S. Pat. No. Des. 282,727 to Bulgari, U.S. Pat. No. Des. 261,121 to Barr and Des. 216,371 to Winchell.

OBJECTS AND SUMMARY OF INVENTION

An object of this invention is to provide a pendant jewelry, such as a necklace, that can be converted from a pendant jewelry of a first configuration to a pendant jewelry of a second configuration or even third configuration.

Another object of the invention is to provide a pendant jewelry that has a symbolic nature that can be configured into another configuration of pendant jewelry.

The pendant necklace of this invention has a chain having a first end and a second end, a pendant member having a first end and a second end, the pendant member having at least three pendant elements pivotally connected to each other by hinges that permit adjacent elements to pivot about each other in a plane. A pivot stop is associated with each hinge. The first end of the chain is attached to the first end of the pendant member and the second end of the chain is attached to the second end of the pendant member. An attachment means is provided for releasably attaching the first end of the pendant member to the second end of the pendant member. When the first end of the pendant member is attached to the second end of the pendant member, the pendant has a first closed configuration that hangs from the ends of the chain member, e.g., a Star of David, heart or cross. When the first end of the pendant member is released from the second end of the pendant member, adjacent pendant elements pivot about each other in the plane to form a pendant having a second open configuration that hangs from the ends of the chain member. The pendant elements are prevented from pivoting about each other to a predetermined angle by the pivot stops to thereby prevent the first end of the pendant member from contacting the second end of the pendant member to prevent the second open configuration from closing.

BRIEF DESCRIPTION OF THE DRAWINGS

These with other objects and advantages which will become apparent reside in the details of construction and operation as will be more fully described and claimed, reference being made to the accompanying drawings forming a part hereof, wherein like numerals refer to like parts throughout, and in which:

Reference is made to FIGS. 1–14 to assist in understanding this invention.

FIG. 5*a* is an enlarged front view of the hinge when the convertible pendant jewelry in a first configuration as shown in FIG. 5;

FIG. 5*b* is an enlarged front view of the hinge when the convertible pendant jewelry is in, for example, another configuration as shown in FIG. 6;

FIG. 5*c* is an enlarged perspective of the hinge mechanism shown in FIGS. 5*a* and 5*b;*

DETAILED DESCRIPTION OF INVENTION

Figure 1:
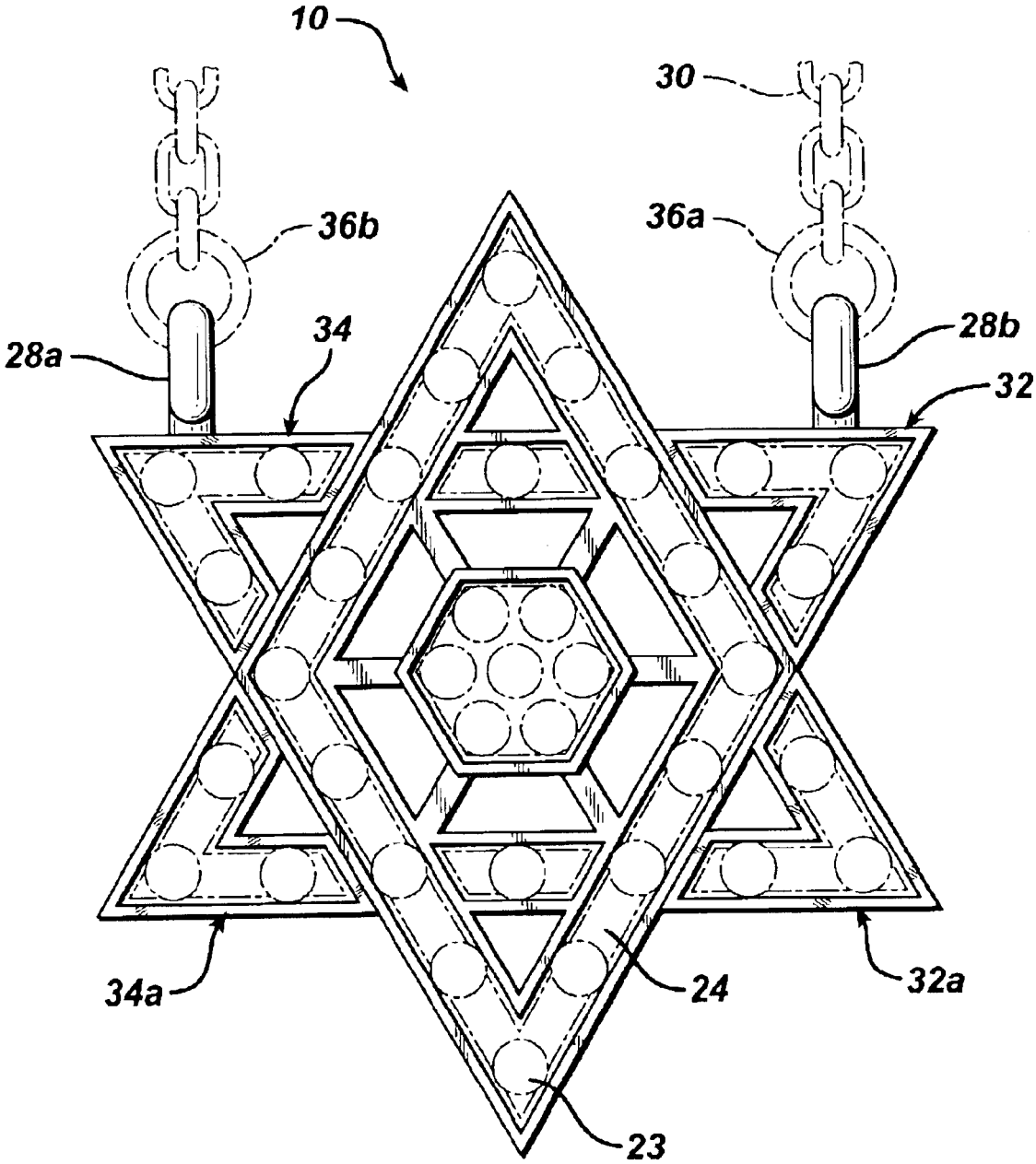
FIG. 1 is a front view of the convertible pendant jewelry in a first configuration in the shape of the Star of David.

Referring to FIGS. 1–4, a pendant necklace is depicted having a first configuration of a Star of David 10. In general, a chain member 30 is provided that has a first end 36*a* and a second end 36*b*. The pendant member 10 has a first end 28*a* and a second end 28*b*, the pendant member 10 comprising five pendant elements 32, 34, 32*a*, 34*a*, 23 pivotally connected to each other by hinges 16, 18, 20, 22 that permit adjacent elements to pivot about each other in a plane, the pendant elements comprising a central element 23 being in the shape of a parallelogram with four sides 23*a*, 23*b*, 23*c*, 23*d* and two angulated elements 32*a*, 32*b* on each side of one angle of the central element 23. A pivot stop is associated with each hinge 15*a*, 15*b*, 15*c*, 15*d*. The first end of the chain 36*a* is attached to the first end of the pendant member 28*a* and the second end of the chain 36*b* is attached to the second end 28*b* of the pendant member 10.

Attachment means 12,14 is provided for releasably attaching the first end 28*a* and second end 28*b* of the pendant member 10 to adjacent sides 23*a*, 23*b* of the central element 23. The attachment means 12,14 may, for example, comprise mating latches on ends 28*a*, 28*b* and sides 23*a*, 23*b* or a magnet on, for example ends 28*a*, 28*b*. When the first and second ends 28*a*, 28*b* of the pendant member 10 are attached to adjacent sides 23*a*, 23*b* of the central element 23, each angulated pendent element 32, 32*a*, 34, 34*a* contacts a side 23*b*, 23*c*, 23*a*, 23*d*, respectively, of the central element 23 to form a first closed configuration in the shape of the Star of David that hangs from the ends of the chain member 30. (See FIGS. 1 and 3)

Figure 2:
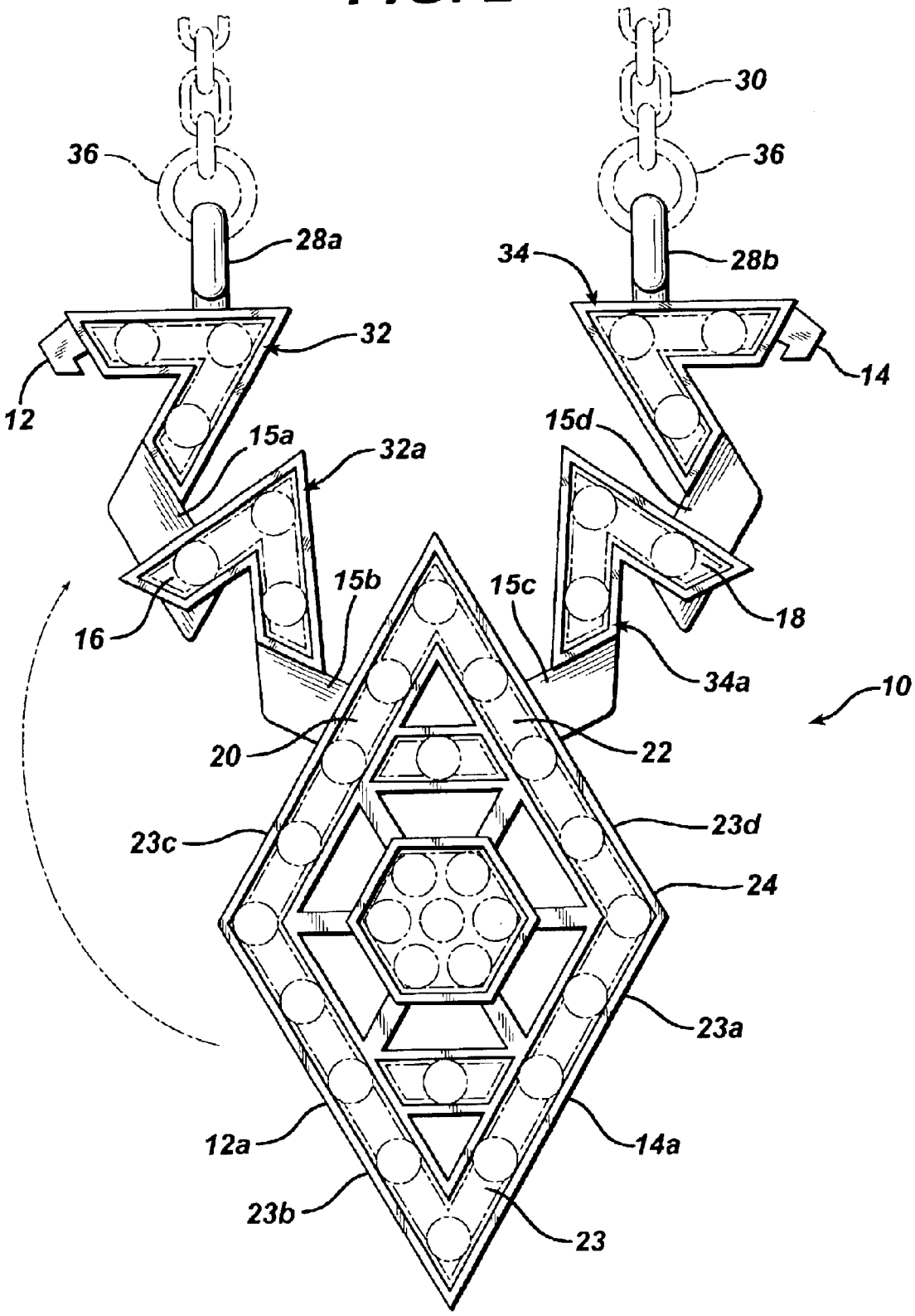
FIG. 2 is a front view of the Star of David convertible pendant jewelry shown in FIG. 1 opened to another configuration.
Figure 4:
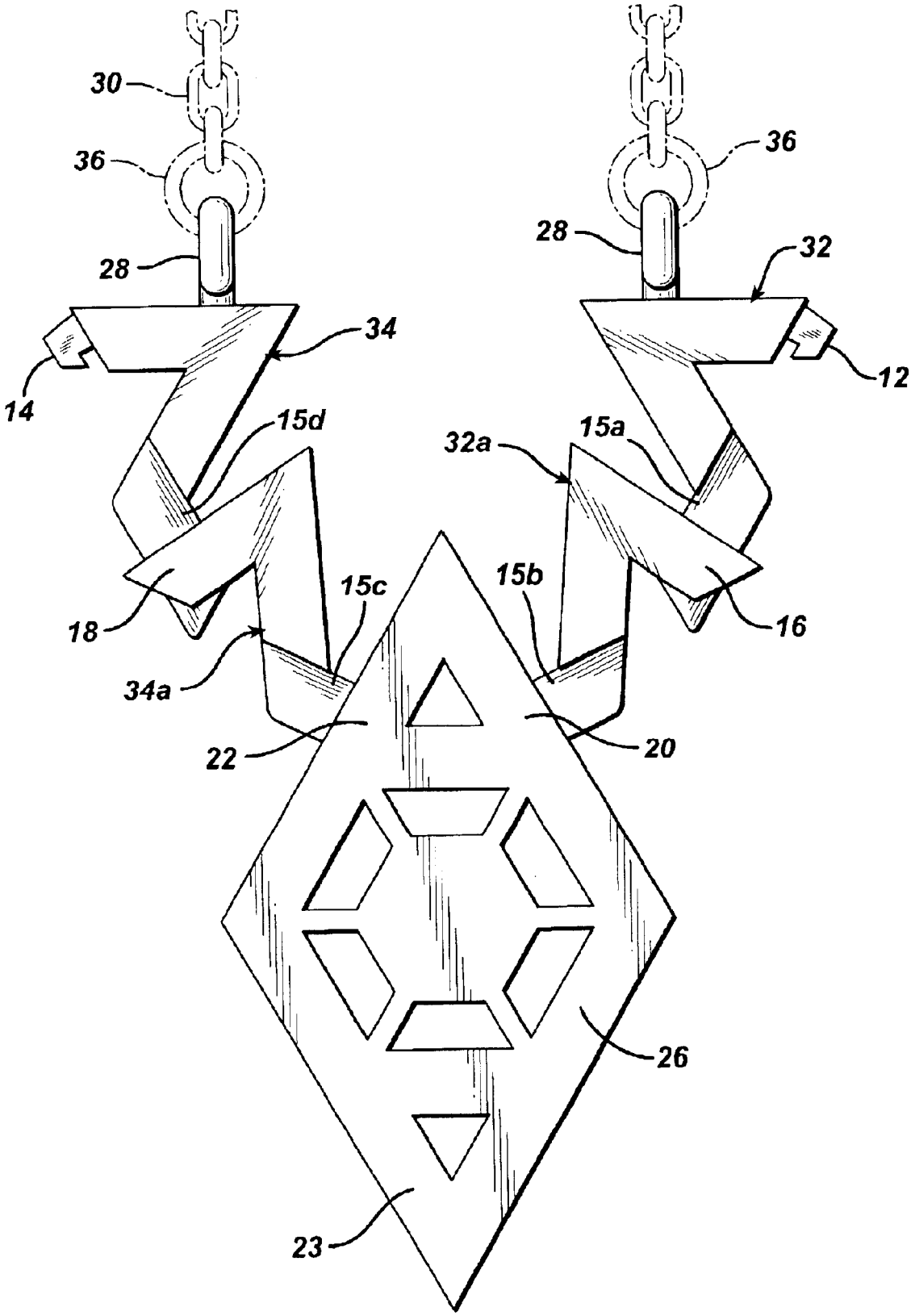
FIG. 4 is a rear view of the Star of David convertible pendant jewelry configured as in FIG. 2.

When the first and second ends 28*a*, 28*b* of the pendant member are released from the adjacent sides 23*b*, 23*a*, respectively, of the central member 23, adjacent pendant elements 23, 32, 32*a*, 34, 34*a* pivot about each other in the plane to form a pendant 10 having a second open configuration that hangs from the ends of the chain member 30, with the central element 23 hanging between two angulated elements 32*a*, 34*a*, the pendant elements 23, 32, 32*a*, 34, 34*a* prevented from pivoting about each other to a predetermined angle by the pivot stops 15*a*, 15*b*, 15*c*, 15*d* (See FIG. 4) to thereby prevent the first end 28*a* of the pendant member 10 from contacting the second end 28*b* of the pendant member 10 to prevent the second open configuration from closing (See FIGS. 2 and 4).

With somewhat more specificity and still referring to FIGS. 1–4, this embodiment of the invention is in the shape of a pendant Star of David 10. The Star 10 is suspended from a chain 30 attached to two sets of attachment rings 28 and 36, one set being attached to angulated articulated member 34 and the other set being attached to angulated articulated member 32. Members 32 and 34 are pivotally attached to angulated articulated members 32*a* and 34*a* (respectively) about hinge members 16 and 18 (respectively). Articulated member 32*a* and 32*b* are pivotally attached to an apex of diamond shaped member 23, near each other and on hinge members 20 and 22, respectively, that pass through member 23. This is shown in FIGS. 2 and 4.

At the ends of angulated articulated members 32 and 34 are locking members 12 and 14 which lock on to mating locking members 12*a* and 14*b*, respectively, that are mounted on or embedded in diamond shaped member 23.

Figure 3:
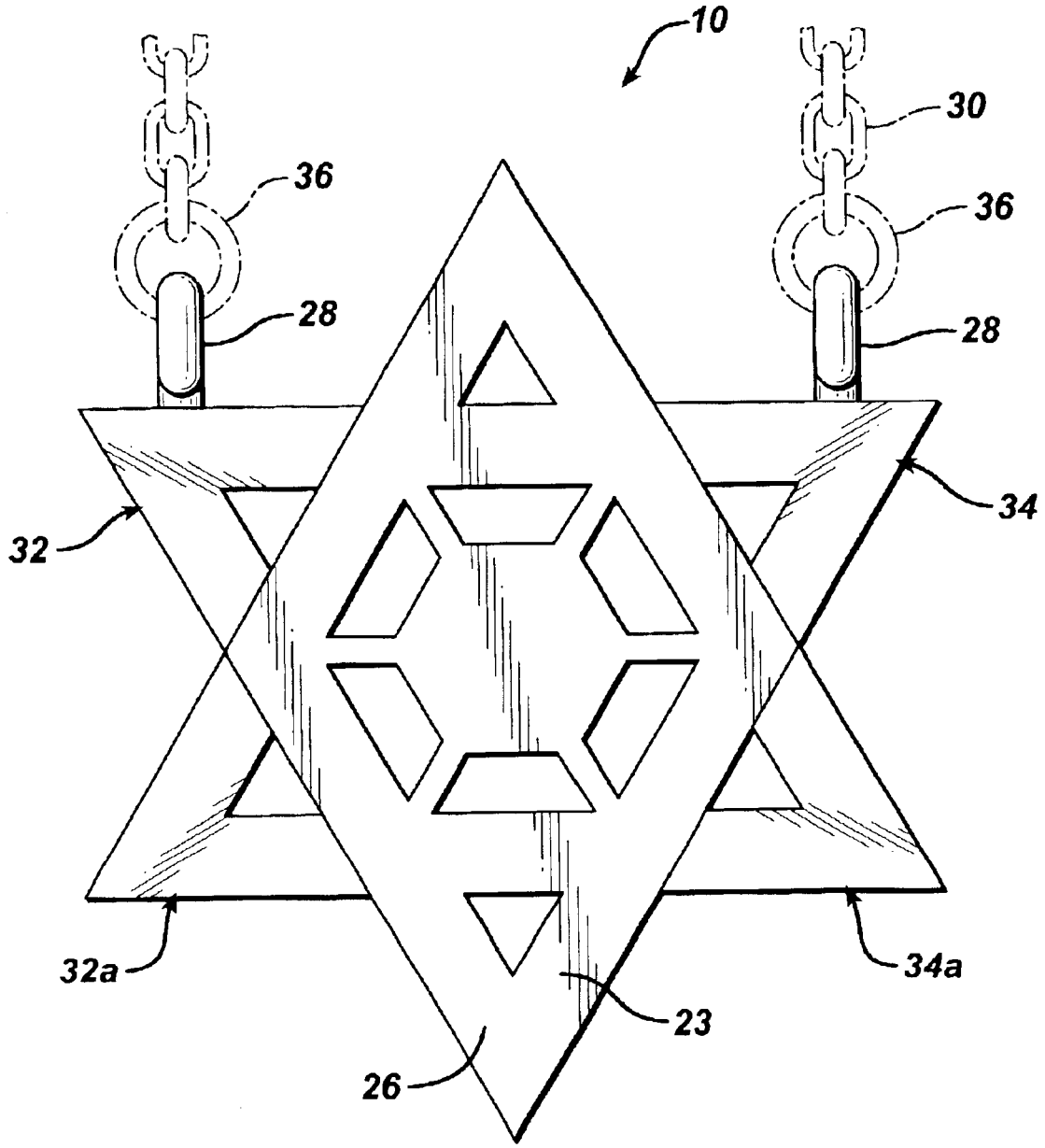
FIG. 3 is a rear view of the Star of David convertible pendant jewelry configured as in FIG. 1.

When the locking members 12 and 14 are mated with corresponding locking member 12*a* and 12*b*, the Star of David is formed and suspended from chain 30 (FIGS. 1 and 3). When the locking members are detached from each other, the angulated articulated members 32, 32*a*, 34 and 34*a* pivot about hinge members 20, 22, 16 and 18 due to the weight of the jewelry and the pendant Star of David is converted to another pendant configuration (FIGS. 2 and 4).

Referring to FIGS. 5–8, a pendant necklace is provided that has a chain member 30 having a first end 36*a* and a second end 36*b*. The pendant member 110 has a first end 28*a* and a second end 28*b*. The pendant member 110 comprises four curvilinear pendant elements 32, 32*a*, 34, 34*a* pivotally connected to each other by hinges 16, 18, 20 that permit adjacent elements to pivot about each other in a plane. A pivot stop 15*a*, 15*b*, 15*c* is associated with each hinge 18, 20, 16, respectively. The first end 36*a* of the chain 30 is attached to the first end 28*a* of the pendant member 110 and the second end 36*b* of the chain 30 is attached to the second end 36*b* of the pendant member 110.

An attachment means 12, 12*a* is provided for releasably attaching the first end 28*a* of the pendant member 110 to the second end 28*b* of the pendant member 110. The attachment means 12, 12*a* may, for example, comprise mating latches on each end of the pendant member or a magnetized latch, e.g., similar to that depicted in FIG. 9*a*, discussed below.

Figure 5:
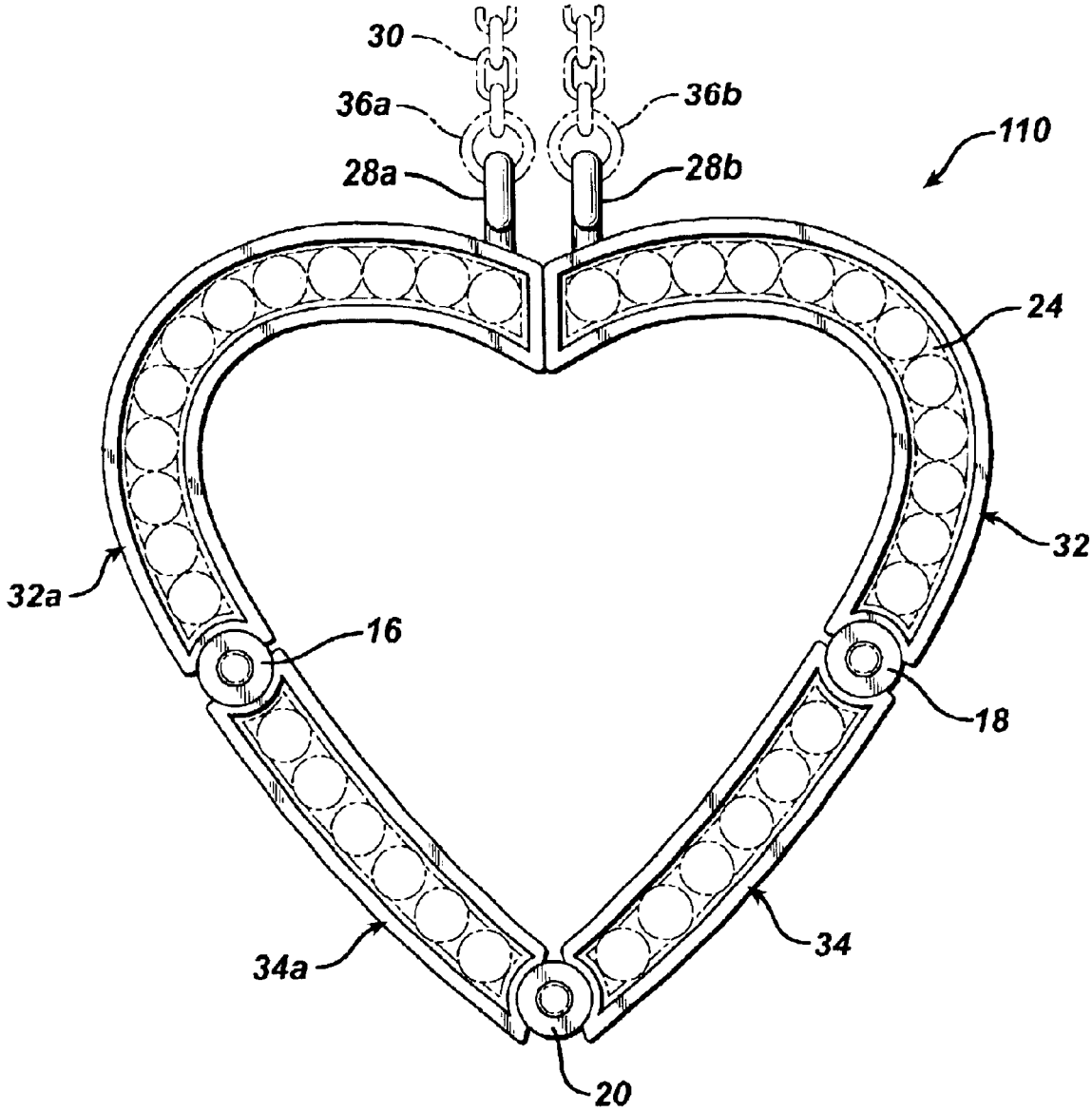
FIG. 5 is a front view of the convertible pendant jewelry in a first configuration in the shape of a heart.
Figure 7:
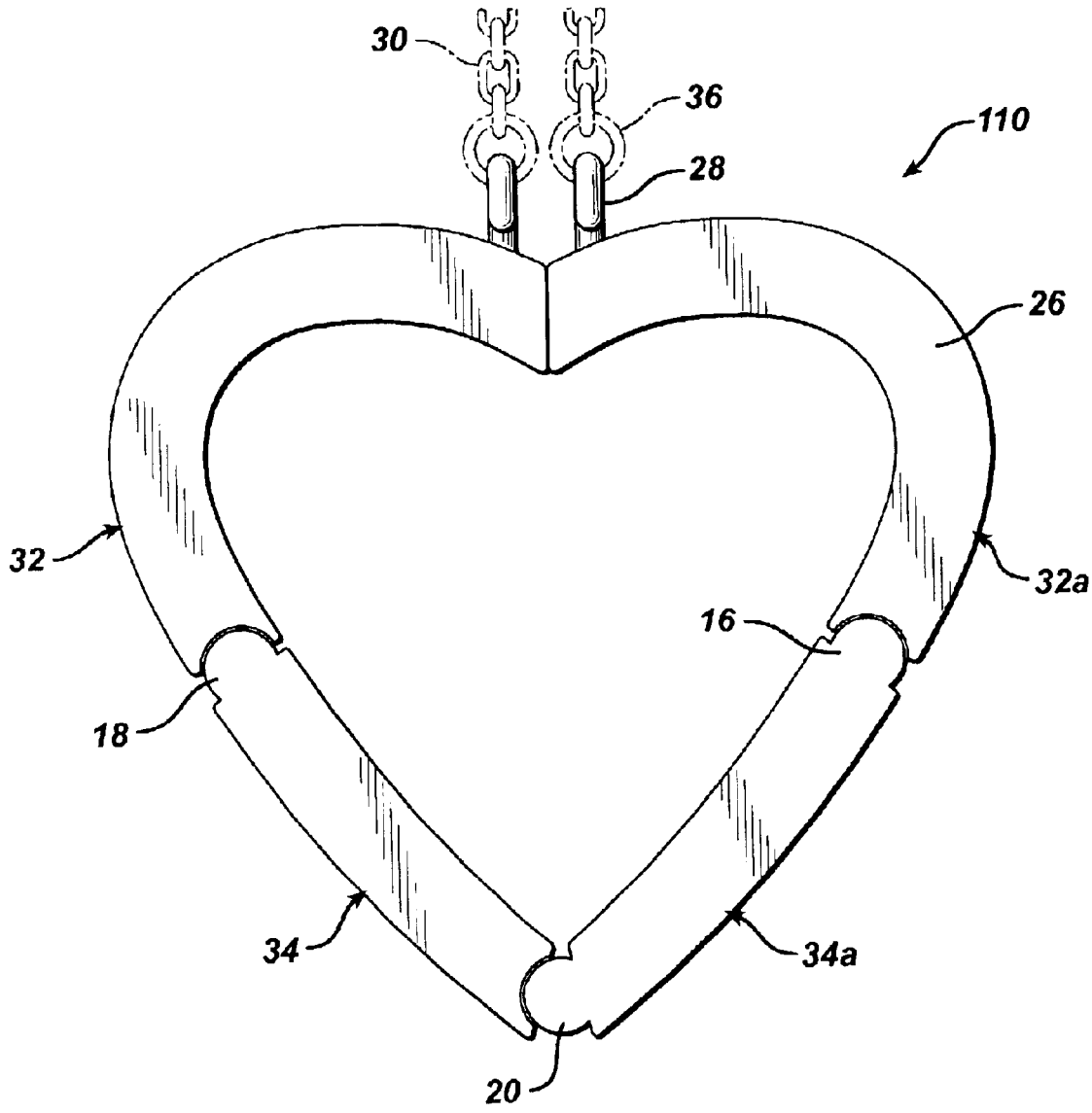
FIG. 7 is a rear view of the heart shaped convertible pendant jewelry configured as in FIG. 5.

When the first end 28*a* of the pendant member 110 is attached to the second end 28*b* of the pendant member 110, the curvilinear pendent elements 32, 32*a*, 34, 34*a* form a first closed configuration in the shape of a heart that hangs from the ends of the chain member 30 (FIGS. 5 and 7).

Figure 6:
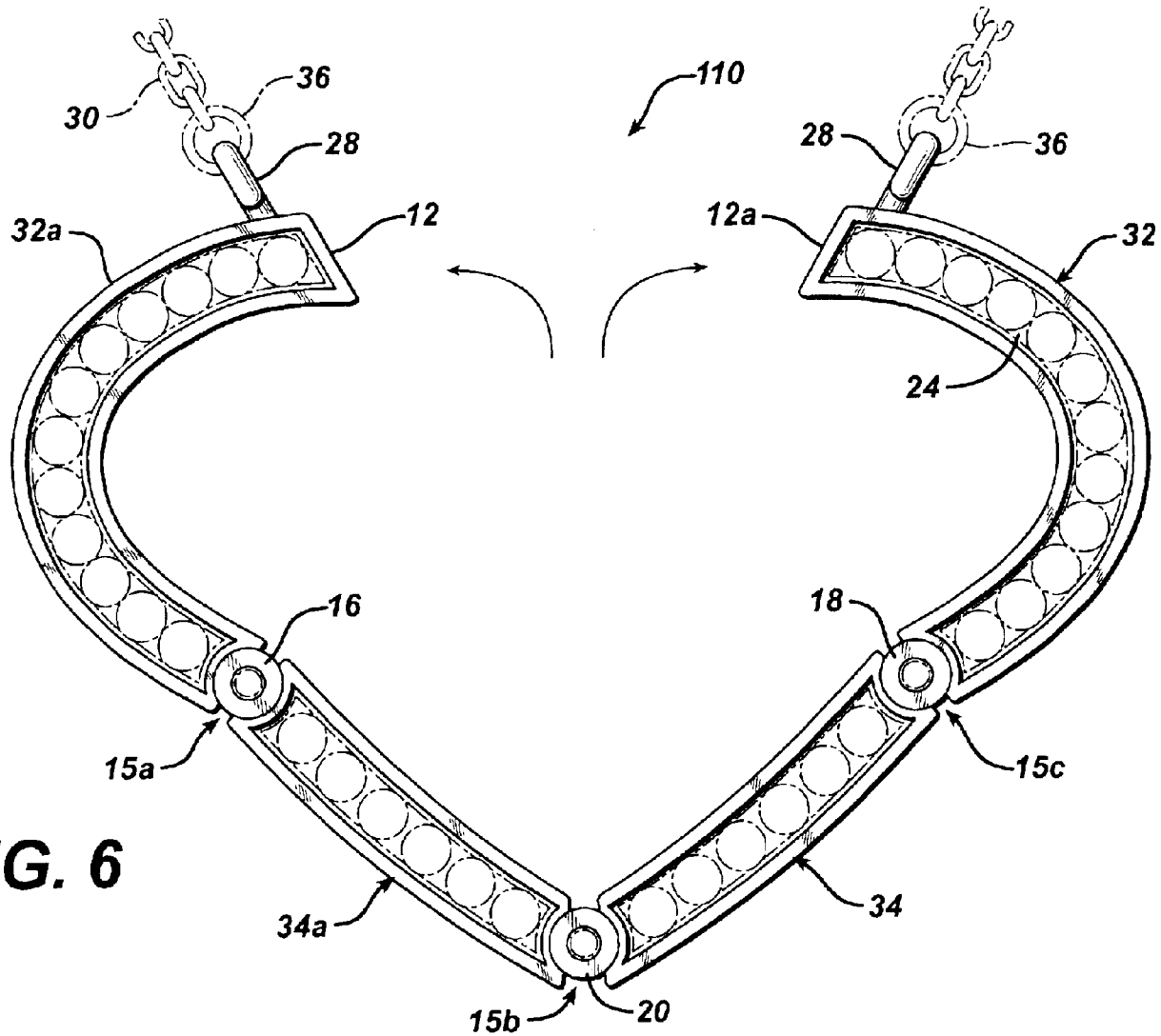
FIG. 6 is a front view of the heart shaped convertible pendant jewelry shown in FIG. 5 opened to another configuration.
Figure 8:
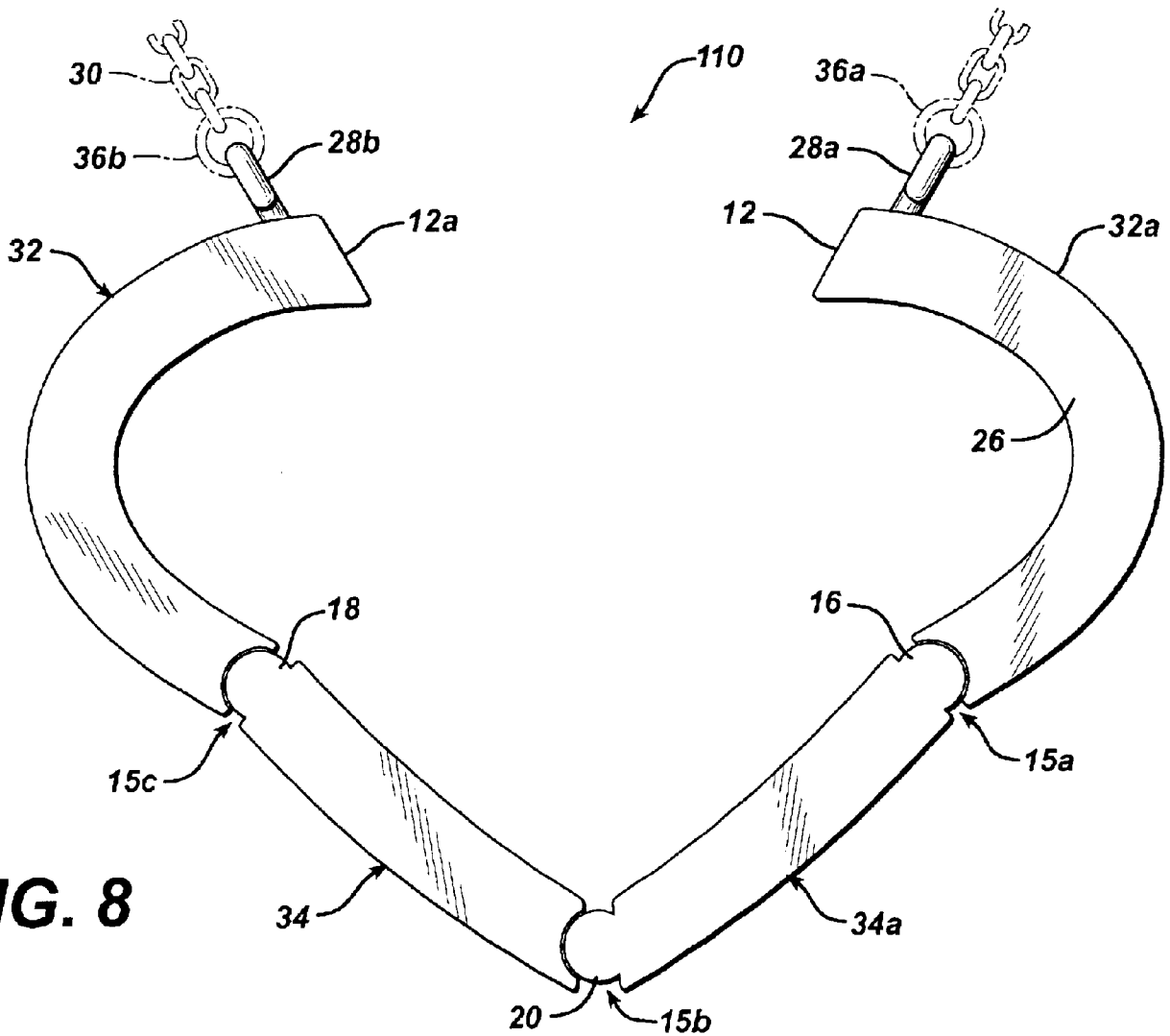
FIG. 8 is a rear view of the heart shaped convertible pendant jewelry configured as in FIG. 6.

When the first end 28*a* of the pendant member 110 is released from the second end 28*b* of the pendant member 110, adjacent pendant elements 32, 32*a*, 34, 34*a* pivot about each other in the plane around the hinges 16, 18, 20 (see FIGS. 5*a*–5*c*) to form a pendant 110 having a second open configuration that hangs from the ends 36*a*, 36*b* of the chain member 30, the pendant elements 32, 32*a*, 34, 34*a* prevented from pivoting about each other to a predetermined angle by the pivot stops 15*a*, 15*b*, 15*c* (see FIGS. 6 and 8) to thereby prevent the first end 28*a* of the pendant member 110 from contacting the second end 28*b* of the pendant member 110 to prevent the second open configuration from closing FIGS. 6 and 8).

With somewhat more specificity and still referring to FIGS. 5–8, this embodiment of the invention is in the shape of a pendant Heart 110. The Heart 110 is suspended from a chain 30 attached to two sets of attachment rings 28 and 36, one set being attached to arcuate articulated member 32 and the other set being attached to arcuate articulated member 32*a*. Members 32 and 32*a* are pivotally attached to arcuate articulated members 34 and 34*a* (respectively) about hinge members 16 and 18 (respectively). Arcuate member 34 and 34*a* are pivotally attached to each other about hinge member 20.

At the ends of arcuate articulated members 32 and 32*a* are mating locking members 12 and 12*a* which lock on to each other. When the locking members 12 and 12*a* are mated with each other a Heart shaped pendant is formed and suspended from chain 30. When the locking members are detached from each other, the arcuate articulated members 32, 32*a*, 34 and 34*a* pivot about hinge members 20, 16 and 18 due to the weight of the jewelry and the pendant Heart is converted to another pendant configuration, see FIGS. 6 and 8.

Referring to FIGS. 9–14, a pendant necklace is provided that has a chain member 30 having a first end 36*a* and a second end 36*b*. A pendant member 210 has a first end 28*a* and a second end 28*b*, the pendant member 210 comprising four arcuate pendant elements 32, 32*a*, 34, 34*a* pivotally connected to each other by hinges 16, 18, 20 that permit adjacent elements to pivot about each other in a plane. A pivot stop 15*a*, 15*b*, 15*c* is associated with each hinge 16, 18, 20.

The first end 36*a* of the chain 30 is attached to the first end 28*a* of the pendant member 210 and the second end 36*a* of the chain 30 is attached to the second end 28*b* of the pendant member 210. An attachment means 12, 12*a* is provided for releasably attaching the first end 28*a* of the pendant member 210 to the second end 28*b* of the pendant member 210. The attachment means 12, 12*a* may, for example, comprise mating latches on each end of the pendant member or a magnetized latch.

Figure 9:
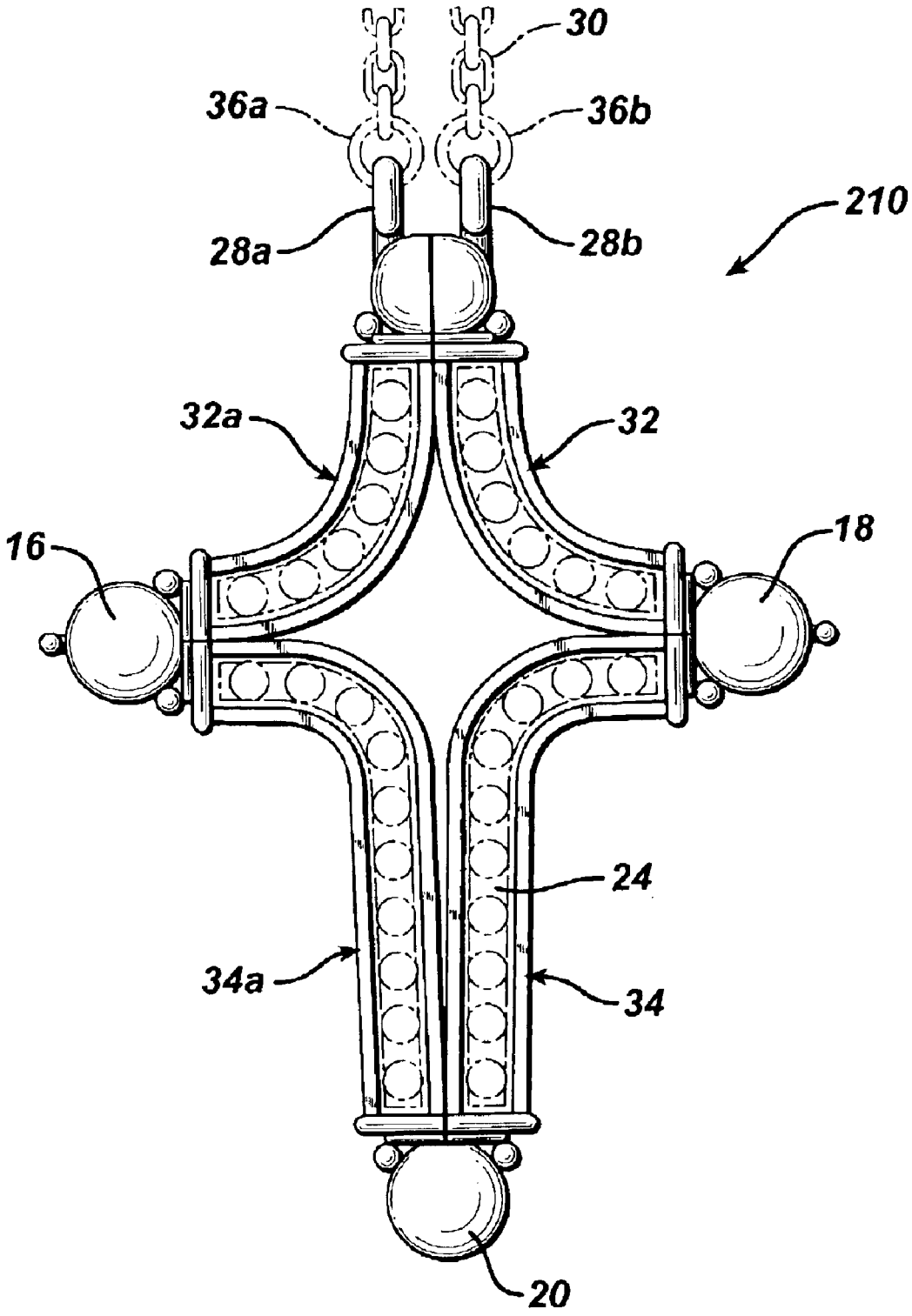
FIG. 9 is a front view of the convertible pendant jewelry in a first configuration in the shape of a cross.
Figure 12:
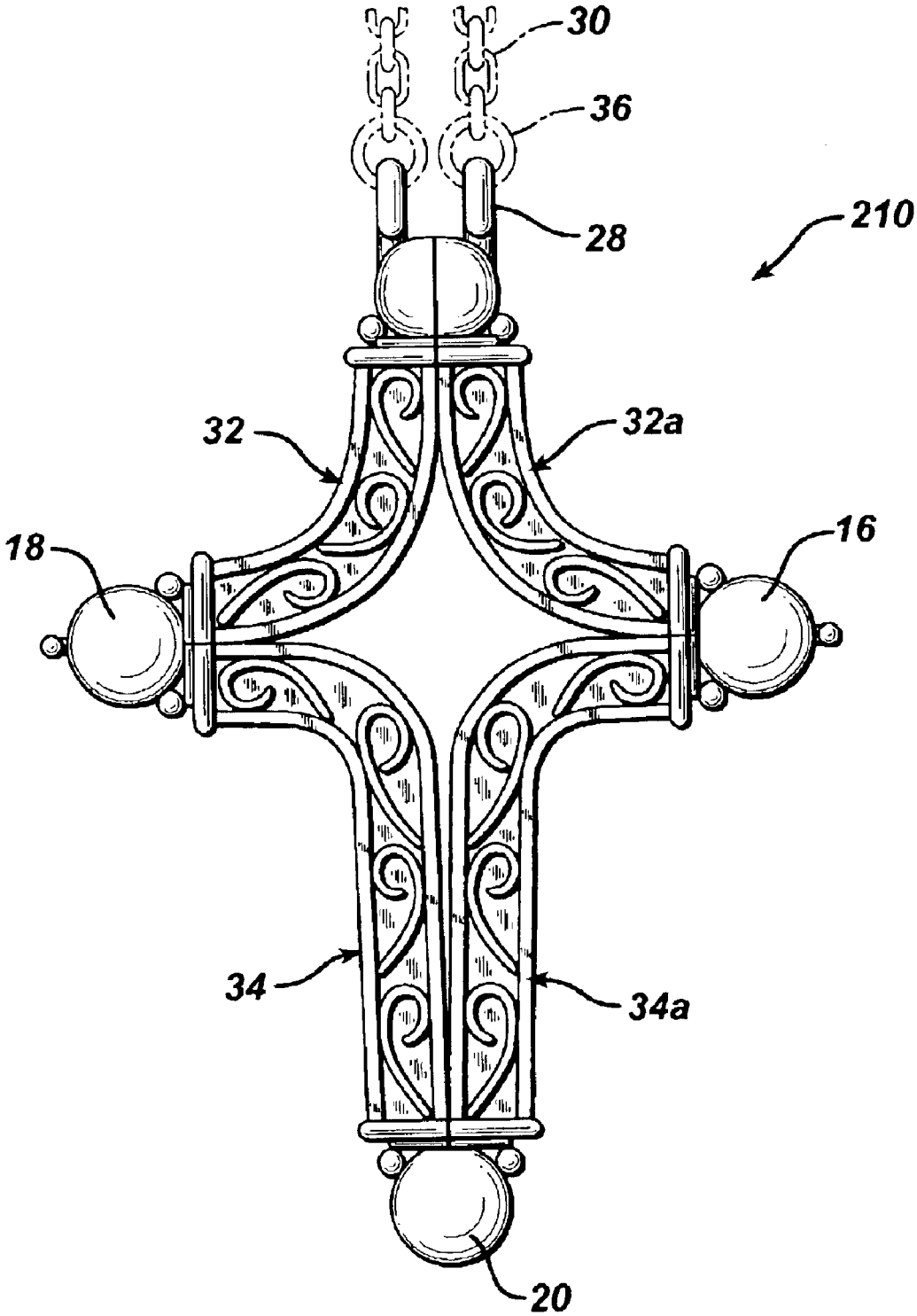
FIG. 12 is a rear view of the convertible pendant jewelry in the shape of a cross configured as in FIG. 9.
Figure 13:
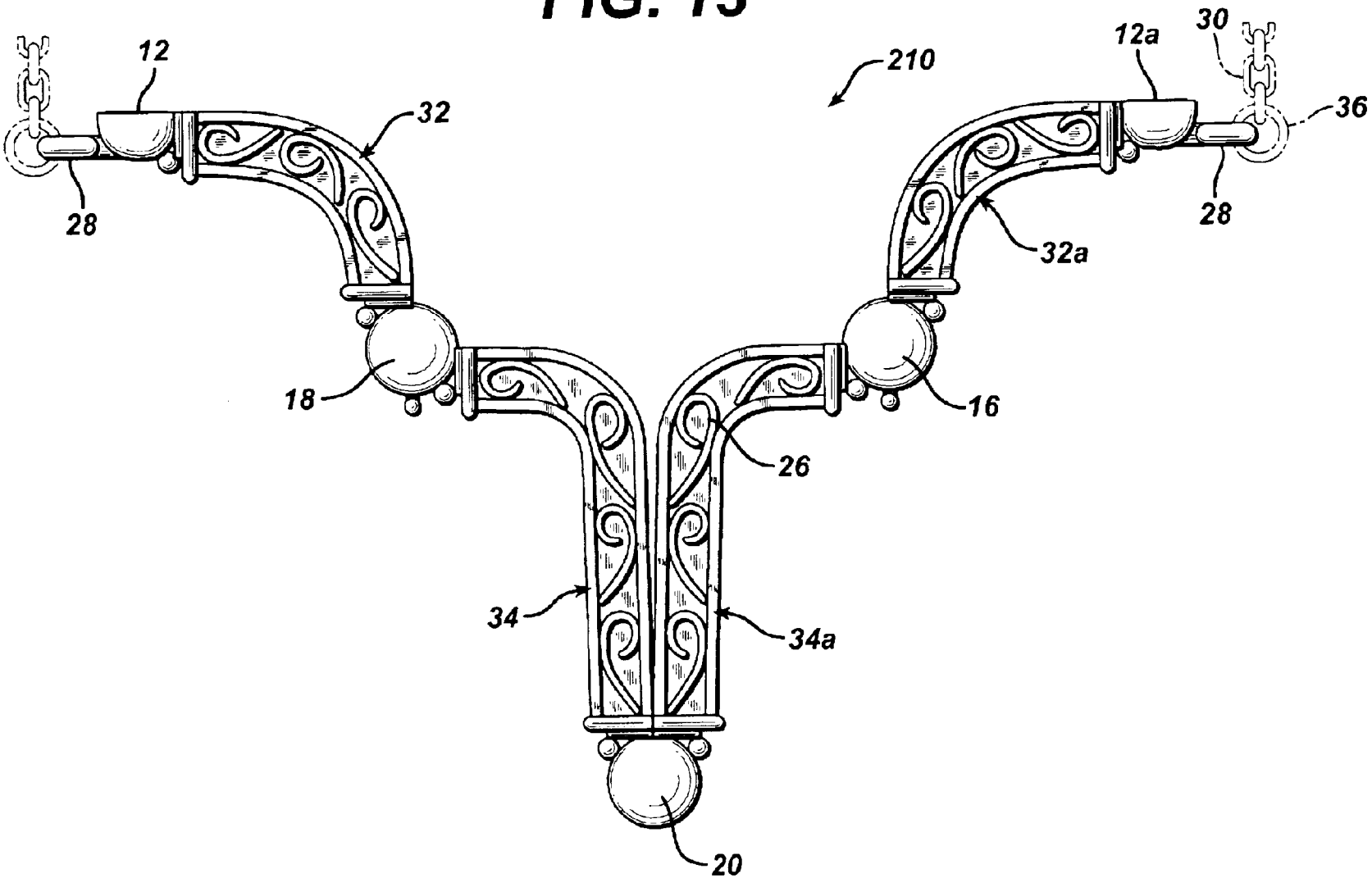
FIG. 13 is a rear view of the convertible pendant jewelry in the shape of a cross configured as in FIG. 10.

When the first end 28*a* of the pendant member 210 is attached to the second end 28*b* of the pendant member 210, the arcuate pendent elements 32, 32*a*, 34, 34*a* form a first closed configuration in the shape of a cross that hangs from the ends 36*a*, 36*b* of the chain member 30. (FIGS. 9 and 12)

When the first end 28*a* of the pendant member 210 is released from the second end 28*b* of the pendant member 210, adjacent pendant elements 32, 32*a*, 34, 34*a* pivot about each other in the plane to form a pendant 210 having a second open configuration that hangs from the ends 36*a*, 36*b* of the chain member 30, the pendant elements 32, 32*a*, 34, 34*a* prevented from pivoting about each other to a predetermined angle by the pivot stops 15*a*, 15*b*, 15*c* to thereby prevent the first end 28*a* of the pendant member 210 from contacting the second end 28*b* of the pendant member 210 to prevent the second open configuration from closing. (FIGS. 10, 11, 13 and 14.)

With somewhat more specificity and referring to FIGS. 9–14, this embodiment of the invention is in the shape of a pendant Cross 210. The Cross 210 is suspended from a chain 30 attached to two sets attachment rings 28 and 36, one set being attached to arcuate articulated member 32 and the other being attached to arcuate articulated member 32*a*. Members 32 and 32*a* are pivotally attached to arcuate articulated members 34 and 34*a* (respectively) about hinge members 16 and 18 (respectively). Arcuate member 34 and 34*a* are pivotally attached to each other about hinge member 20.

Figure 9A:
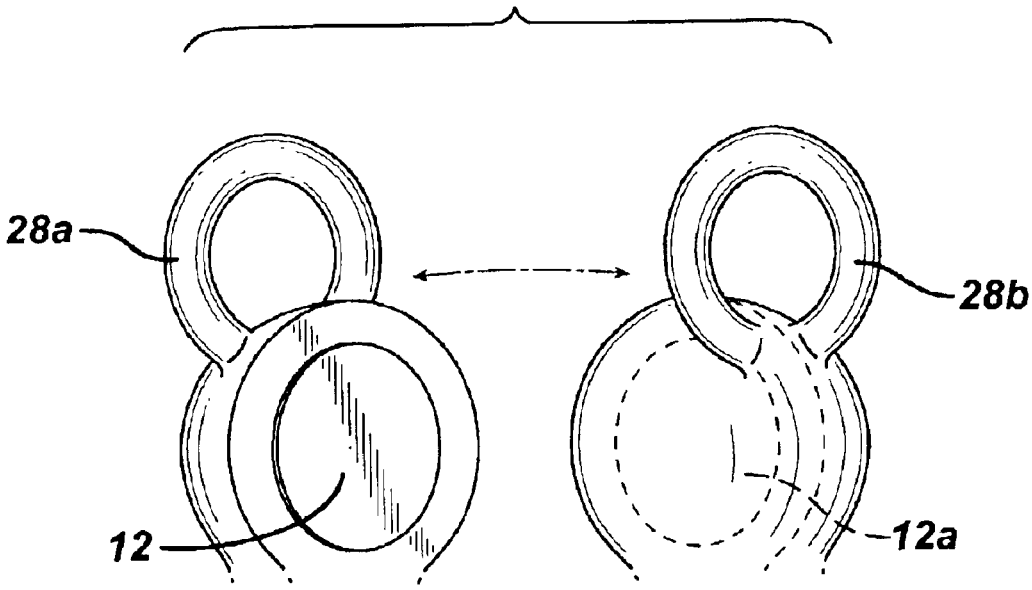
FIG. 9*a* is an enlarged perspective view showing a magnetic attachment means for releasably attaching the first end of the pendant member to the second end of the pendant member.
Figure 10:
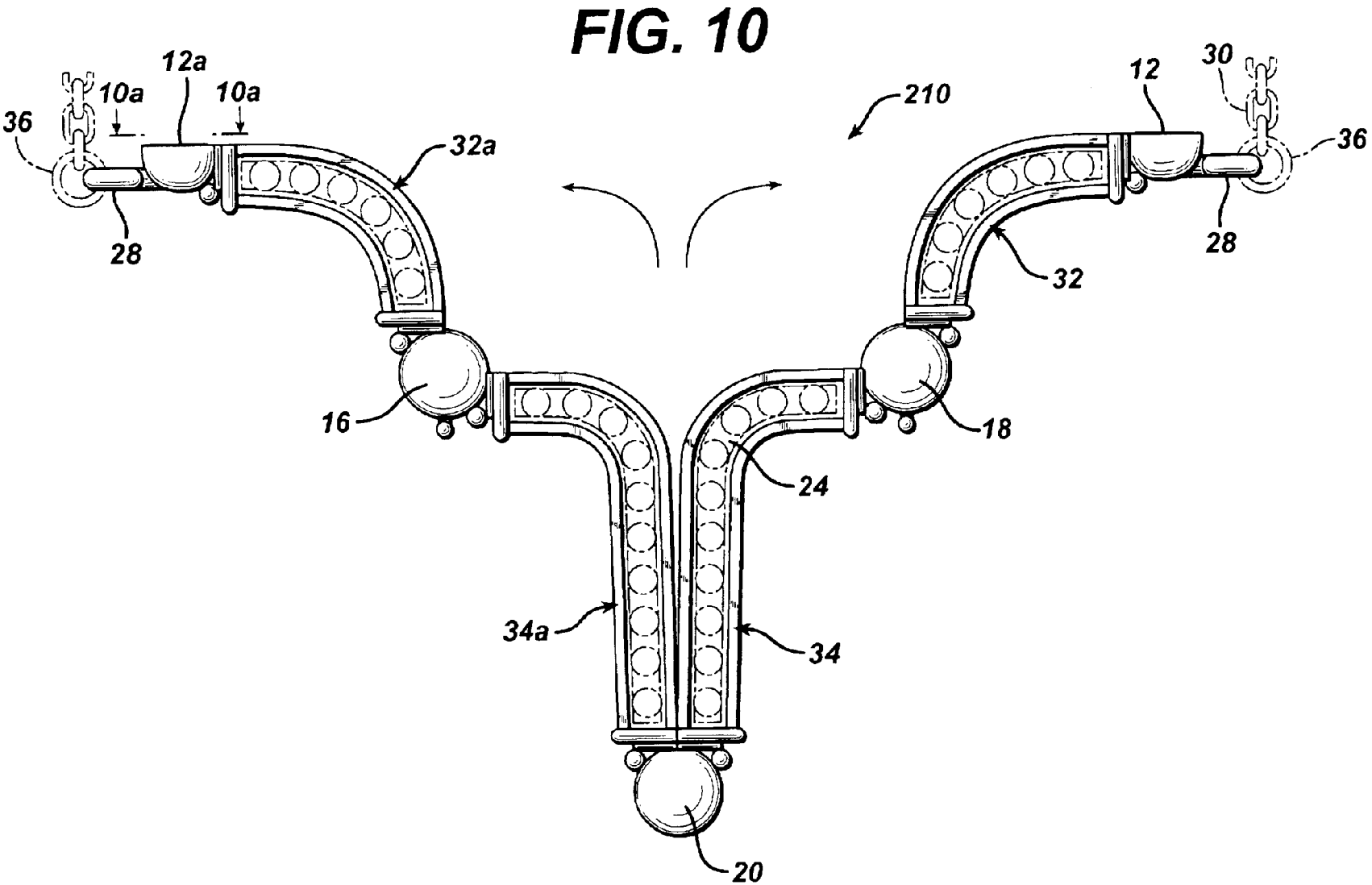
FIG. 10 is a front view of the convertible pendant jewelry in the shape of a cross shown in FIG. 9 opened to another configuration
Figure 11:
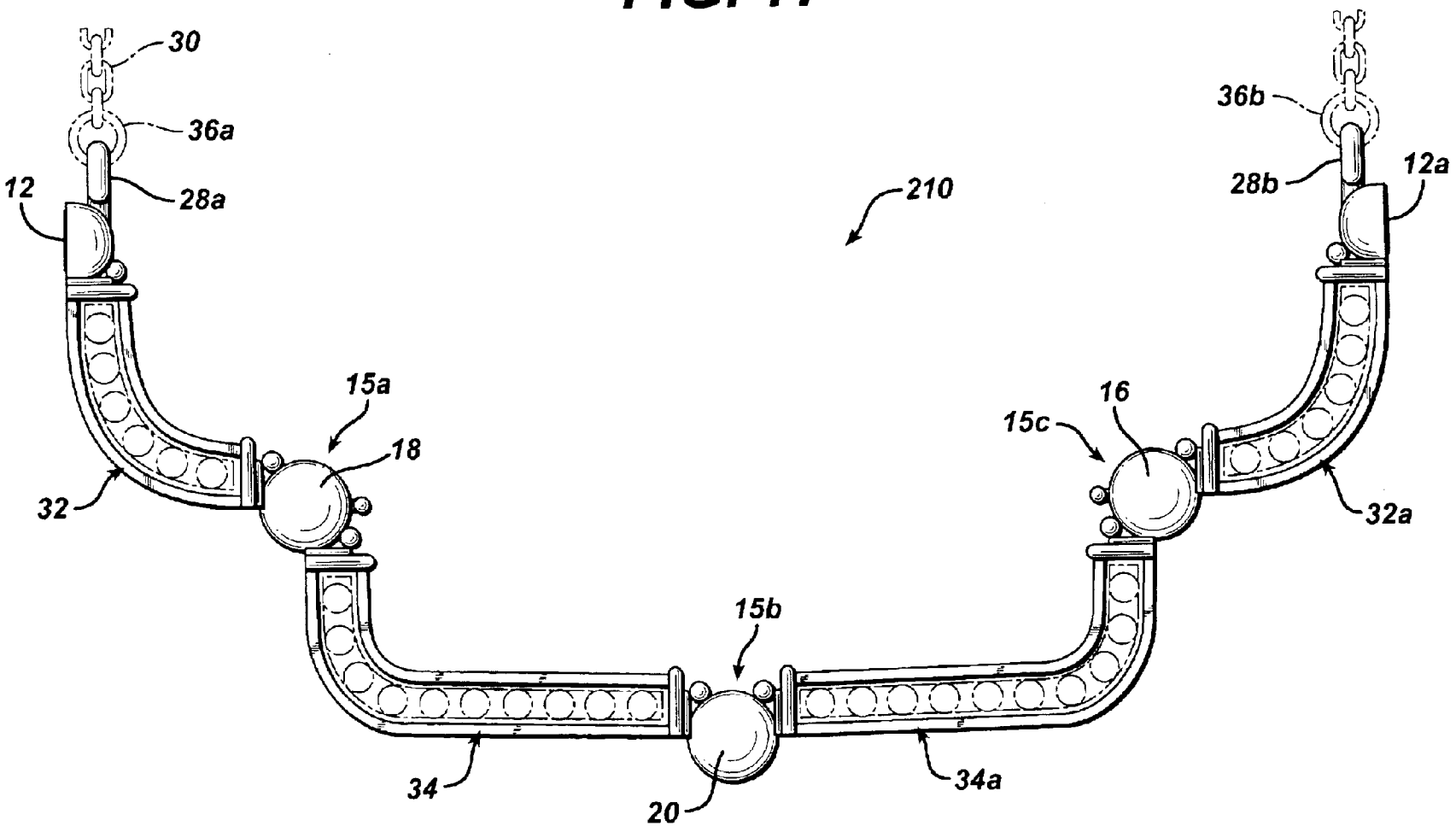
FIG. 11 is a front view of the convertible pendant jewelry in the shape of a cross shown in FIG. 9 opened to a third configuration.
Figure 14:
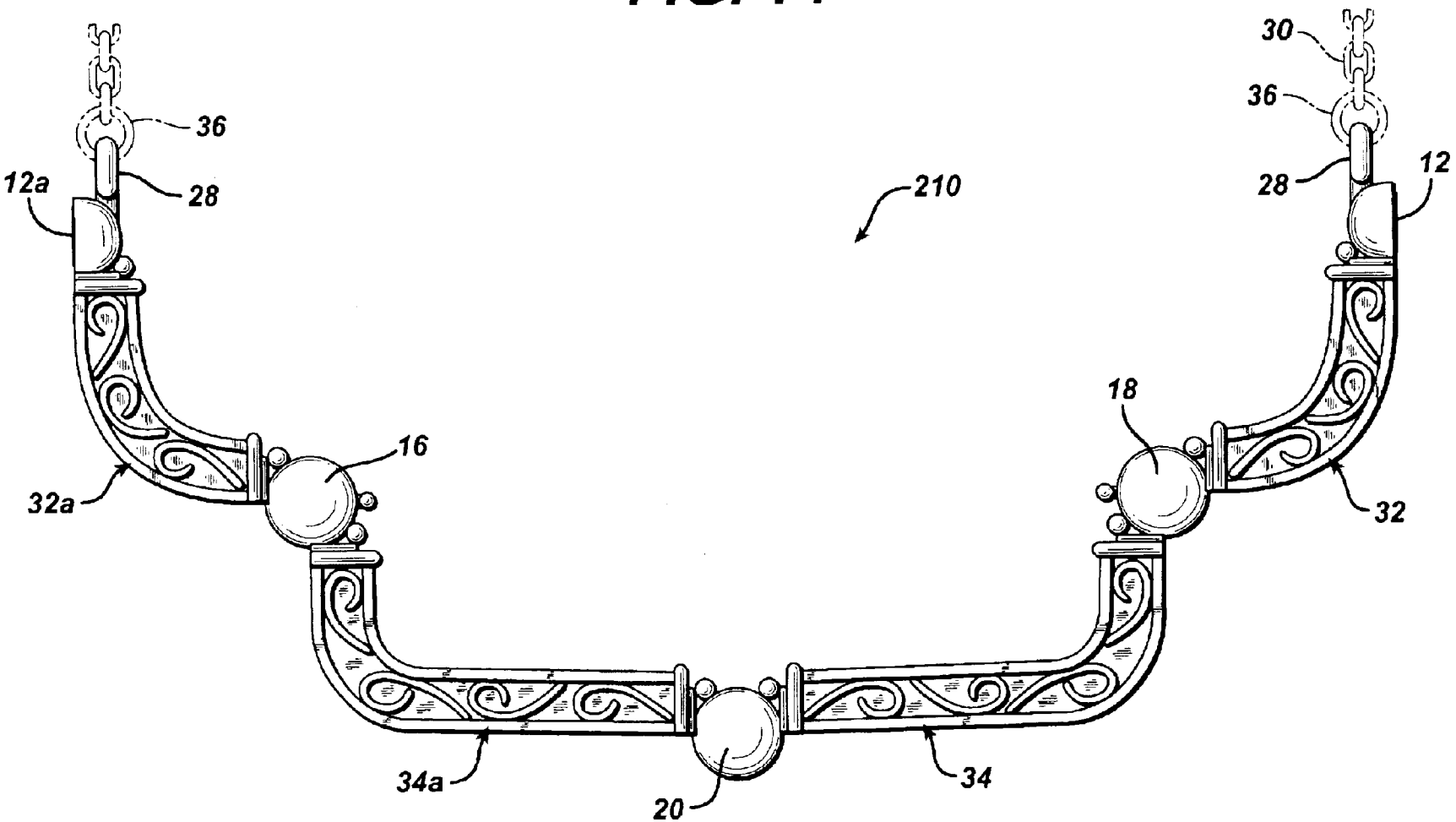
FIG. 14 is a rear view of the convertible pendant jewelry in the shape of a cross configured as in FIG. 11.

At the ends of arcuate articulated members 32 and 32*a* are mating locking members 12 and 12*a* which lock on to each other. When the locking members 12 and 12*a* are mated with each other a Cross shaped pendant is formed and suspended from chain 30. When the locking members are detached from each other, the arcuate articulated members 32, 32*a*, 34 and 34*a* pivot about hinge members 16, 18, 20 due to the weight of the jewelry and the pendant Cross is converted to another pendant configuration, see FIGS. 10 and 13 or yet another configuration as shown in FIGS. 11 and 14. The locking members may be latches, for example as depicted in FIGS. 2 and 4, elements 12 and 14 or magnetic as depicted in FIG. 9*a* with element 12 and 12*a* being magnetically attracted to each other.

The description of invention herein makes reference to several preferred embodiments. Those skilled in the art, however, and familiar with the disclosure of the subject invention, may recognize additions, deletions, substitutions, modifications, and/or other changes which will fall within the purview of the invention as defined in the following claims.

What is claimed is:

1. A pendent jewelry, comprising a chain member having a first end and a second end: a pendent member having a first end and a second end and comprising a plurality of pendent elements pivotally connected to each other by hinges that permit adjacent elements to pivot about each other in a plane; wherein the first end of the chain is attached to the first end of the pendent member and the second end of the chain is attached to the second end of the pendent member; means for releasably connecting the chain member to the pendent member; a pivot stop associated with each hinge, said stop extending laterally from a respective one of said pendant elements; attachment means; wherein the pendent elements of the pendent member are formed so that they can form the pendent member with a first closed configuration that hangs from the ends of the chain members and is fixed by said attachment means, and the pendent elements can pivot about each other in the plane to form the pendent member having a second open configuration that hangs from the ends of the chain member and the pendent elements are stopped and prevented from pivoting about each other to a predetermined angle by the pivot stops.

2. A pendent jewelry as defined in claim 1, wherein the pendent elements are formed so that when the first end of the pendent member is attached to the second end of the pendent member, the pendent member has the first closed configuration, and when the first end of the pendent member is released from the second end of the pendent member the pendent elements pivot about each other to form the second open configuration with the pivot stops preventing the first end of the pendent member from contacting the second end of the pendent member to prevent the second open configuration from closing.

3. A pendent jewelry as defined in claim 1, wherein the attachment means comprises mating latches at each end of the pendent member.

4. A pendent jewelry as defined in claim 1, wherein the attachment means comprises a magnetized latch.

5. A pendent jewelry as defined in claim 1, wherein the pendent members comprises include at least three pendent elements.

6. A pendent jewelry as defined in claim 1, wherein the attachment means is formed to releasably attach the first end of the pendent member to the second end of the pendent member.

7. A pendent jewelry as defined in claim 1, wherein the plurality of the pendent elements of the pendent member include five pendent elements pivotally connected to each other by the hinges with a central element shaped as a parallelogram with four sides and two angulated elements on each side of one angle of the central element including a first angulated element pivotally connected with said central element and a second angulated pendant element pivotally connected with said first angulated element; wherein in the closed configuration, each angulated element contacts a side of the central element in two points to form the first closed configuration in the shape of a star of David that hangs from the end of the chain member and the attaching means are provided on each of the second angulated elements and on the central element; and in the second open configuration the central element hangs between the two first angulated elements.

8. A pendent jewelry as defined in claim 7, wherein the central element is in the shape of a parallelogram with four sides including two upper sides and two lower sides, so that in the closed configuration the first angulated elements are associated with the upper sides and the second angulated elements are associated with the lower sides of the central element, and the attachment means are provided on each of the second angulated elements and on the lower sides of the central element.

9. A pendent jewelry as defined in claim 1, wherein the plurality of the pendent elements include four arcuate elements with two first arcuate elements pivotally connected with one another and two second arcuate elements each pivotally connected to a respective one of the first arcuate elements and said second elements are further connected with the first and second ends of the chain member, so that in the closed configuration first portions of first arcuate elements extend substantially parallel and close to one another, first portions of the second arcuate elements also extend substantially parallel and close to one another and form continuations of the first portions of the first arcuate elements, and the second portions of the first arcuate elements and the second portions of the second arcuate elements extend substantially parallel and close to one another and form continuations of each other, while in one open configuration the first portions of the first arcuate elements extend substantially vertically and parallel and close to one another, the second portions of the first arcuate elements extend substantially horizontally and transversely to the first portions of the first arcuate elements, the second portions of the second arcuate elements extend substantially vertically and transversely to the second portions of the first arcuate elements, and the first portions of the second arcuate elements extend substantially horizontally and transversely to the second portions of the second arcuate elements, while in a further open configuration the first portions of the first arcuate elements extend substantially horizontally away from one another, the second portions of the first elements extend substantially vertically from the first portions of the first arcuate pendent elements, the second portions of the second arcuate pendent elements extend substantially horizontally away from the second portions of the first arcuate elements, and the first portions of the second arcuate elements extend substantially vertically and transversely to the second portions of the second arcuate elements.

* * * * *